US007448207B2

(12) United States Patent
Jozsa et al.

(10) Patent No.: US 7,448,207 B2
(45) Date of Patent: Nov. 11, 2008

(54) SYSTEM AND METHOD FOR REDUCTION OF NITROGEN OXIDES FROM EXHAUST GASES GENERATED BY A LEAN-BURN COMBUSTION ENGINE

(75) Inventors: Peter Jozsa, Göteborg (SE); Edward Jobson, Romelanda (SE)

(73) Assignee: Volvo Lastvagnar AB, Gothenburg (SE)

( * ) Notice: Subject to any disclaimer, the term of this patent is extended or adjusted under 35 U.S.C. 154(b) by 115 days.

(21) Appl. No.: 11/576,427

(22) PCT Filed: Nov. 11, 2004

(86) PCT No.: PCT/SE2004/001451

§ 371 (c)(1),
(2), (4) Date: Mar. 30, 2007

(87) PCT Pub. No.: WO2006/052168

PCT Pub. Date: May 18, 2006

(65) Prior Publication Data

US 2008/0060352 A1 Mar. 13, 2008

(51) Int. Cl.
*F01N 3/00* (2006.01)

(52) U.S. Cl. ..... 60/286; 60/274; 60/301; 60/303

(58) Field of Classification Search ..... 60/274, 60/286, 301, 303
See application file for complete search history.

(56) References Cited

U.S. PATENT DOCUMENTS

| | | | | |
|---|---|---|---|---|
| 5,992,141 | A * | 11/1999 | Berriman et al. | 60/274 |
| 6,449,947 | B1 * | 9/2002 | Liu et al. | 60/286 |
| 6,696,389 | B1 | 2/2004 | Boegner et al. | |
| 2004/0177605 | A1 | 9/2004 | Kojima et al. | |

FOREIGN PATENT DOCUMENTS

| | | | |
|---|---|---|---|
| DE | 4441261 | A1 | 5/1996 |
| DE | 10135643 | A1 | 2/2003 |
| EP | 1475140 | A1 | 11/2004 |
| EP | 1515599 | A1 | 3/2005 |
| JP | 8038906 | A | 2/1996 |
| JP | 10212932 | | 8/1998 |
| JP | 2000145434 | | 5/2000 |
| JP | 2002221024 | A | 8/2002 |
| JP | 2002327618 | A | 11/2002 |
| WO | 9828070 | A1 | 7/1998 |
| WO | 0021647 | A1 | 4/2000 |

OTHER PUBLICATIONS

European Search Report from corresponding European Application No. 04 800 241.4.
International Search Report from corresponding International Application PCT/SE2004/001451.
International Preliminary Report on Patentability from corresponding International Application PCT/SE2004/001451.

* cited by examiner

*Primary Examiner*—Thomas E Denion
*Assistant Examiner*—Diem Tran
(74) *Attorney, Agent, or Firm*—WRB-IP LLP

(57) ABSTRACT

In a system and method for reduction of nitrogen oxides from exhaust gases generated by a lean-burn internal combustion engine, a lean NOx catalyst is arranged to be connected to an exhaust conduit of the lean-burn internal combustion engine, an injector is arranged for injecting a reduction agent to be used by the lean NOx catalyst in a reduction process, and a fuel tank contains the reduction agent.

16 Claims, 2 Drawing Sheets

SYSTEM AND METHOD FOR REDUCTION OF NITROGEN OXIDES FROM EXHAUST GASES GENERATED BY A LEAN-BURN COMBUSTION ENGINE

The invention relates to a system for reduction of nitrogen oxides from exhaust gases generated by a lean-burn internal combustion engine and furthermore to a method for reduction of nitrogen oxides from exhaust gases generated by a lean-burn internal combustion engine. In particular the invention relates to a system and method for reduction of nitrogen oxides from exhaust gases generated by a lean-burn internal combustion engine where a reduction agent is injected to a lean NOx catalyst. A lean NOx catalyst is a catalyst which can reduce NOx under lean burn conditions. Examples of lean NOx catalysts that may be used in connection with this invention is provided in EP 830201, U.S. Pat. No. 4,946,659; and US 2003/0069125.

There is a general demand for low emissions of harmful substances in the exhaust gases from vehicles, which are operated by combustion engines. These substances are primarily considered to be pollutants and often take the form of nitrogen oxide compounds (NOx), hydrocarbon compounds (HC), and carbon monoxide (CO). The role of NOx in the urban city is a major problem and in Europe, North America and Japan this concern is reflected in stricter emission legislation. In 1997, leaders from more than 150 countries signed the Kyoto agreement, which involved a solution on how to reduce green house gases such as carbon dioxide (CO2). The CO2 emission from a vehicle is related to the fuel consumption and with the potential of lower fuel consumption from diesel or lean-burn engines, emission of CO2 can be decreased. By replacing diesel as a fuel in heavy-duty trucks with DME, it is possible to considerably reduce emissions such as NOx and particles, from heavy-duty trucks. However it is not possible to achieve the future emission standards in Europe and America by alone changing the fuel, more drastic and innovative methods are required. The conventional three-way catalyst is ineffective of reducing NOx from lean-burn engines and for several years various types of DeNOx catalyst have been studied such as the Lean NOx catalysts (HC-SCR). Known Lean NOx catalyst systems are continuously reducing NOx from the exhaust by using hydrocarbons such as diesel fuel as reducing agent.

A catalytic reactor in an exhaust duct is normally arranged as one of several monolithic bodies of a matrix material providing a plurality of flow channels where the exhaust is exposed to a large surface area carrying a catalytic material. In order for the catalyst to operate properly the flow of the exhaust through the monolithic bodies should have a flow profile which to the largest extent is uniform over the whole cross section of the monolithic bodies. The expression flow profile refers in this context to the distribution of mass flow per area unit over a cross section of a monolithic body.

In lean NOx catalysts a reduction agent is injected in order to perform reduction of NOx over the catalyst. Since the amount of reduction agent is proportional to the amount of NOx to be reduced, the mass flow of the reduction agent should preferably have the same flow profile as the mass flow of exhausts.

In known state of the art systems it has shown to be problematic to inject fuel so as to obtain a flow profile having a sufficient even distribution of mass flow over the cross section of the monolithic body. Therefore, prior art system have suggested the use of mixers positioned in front of the catalytic body, in between the injector and the catalytic body, in order to more evenly distribute the reduction agent over the cross section of the catalytic body. However, introduction of mixers increases the pressure drop over the catalytic device, which thereby reduces the efficiency of the engine and adds to fuel consumption. Furthermore, even after mixers have been installed it has shown to be problematic to control the distribution of the reduction agent and known systems in operation have shown to generate areas with locally increased concentration of reduction agent.

Further attempts have been made to reduce the local variation of the concentration of reduction agent. By increasing the injection pressure it is possible to more evenly distribute the reduction agent over the cross section of the flow channel. However, in order to obtain a sufficiently even distribution of reduction agent, injectors operating with high injection pressures comparable to injection system known for injecting fuel into the combustion chambers of a conventional internal combustion engine must be used.

Injection at high injection pressure reduces the efficiency of the engine and adds to fuel consumption in an unacceptable way.

It is desirable to provide a system for reduction of nitrogen oxides from exhaust gases generated by a lean-burn internal combustion engine where the uniformity of the mass flow over the cross section of the monolithic body is increased in comparison to conventional systems, and which inventive system reduces the need for use of energy consuming accessories such high pressure injection systems and mixers.

According to an aspect of the present invention, a system for reduction of nitrogen oxides from exhaust gases generated by a lean-burn internal combustion engine is provided. The system comprises a lean NOx catalyst arranged to be connected to an exhaust conduit of the lean-burn internal combustion engine, an injector arranged for injecting a reduction agent to be used by the lean NOx catalyst in a reduction process, and a fuel tank containing the reduction agent, wherein the fuel tank is a pressure tank adapted to contain di-methyl-ether as a reduction agent and the injector is adapted to inject di-methyl-ether upstream of the lean NOx catalyst, and wherein the injector includes a set of injection ports, wherein a distance, in a radial direction of a cross section taken along a length axis of an exhaust conduit at a position where the injector is positioned, between the injection ports positioned most distant from each other in said set of injection ports, and an equivalent radius of the lean NOx catalyst fulfill the following relationship: $d/R>0.5$.

According to another aspect of the present invention, a method for reduction of nitrogen oxides from exhaust gases generated by a lean-burn internal combustion engine is provided. The method comprises exposing exhaust gases generated by a lean-burn internal combustion engine to a lean NOx catalyst connected to an exhaust conduit of the lean-burn internal combustion engine, supplying di-methyl-ether as a reduction agent from a pressure tank to an injector and injecting di-methyl-ether upstream of said lean NOx catalyst in order to reduce the nitrogen oxides.

By using di-methyl ether as a reduction agent, the uniformity of the mass flow profile will be increased in comparison to use of other conventional reduction agents, such as diesel fuel, since the di-methyl ether is supplied in gaseous form or will quickly turn into gaseous form shortly after injection. The need to use of mixers in between the injector and the catalytic body will therefore be reduced. Furthermore, since di-methyl ether is stored in a pressure tank, the injection of the di-methyl ether can be propelled be the pressure difference between the pressure tank and the exhaust conduit. The possibility of using the pressure generated by the di-methyl ether stored in the pressure tank obviates the need for inclusion of a pump in the injection system. The control of the injection may be performed by a valve opening and closing the connection between the pressure tank and the injector.

BRIEF DESCRIPTION OF DRAWINGS

An embodiment of the invention will be described in detail below, with references to appended drawings, wherein FIG. 1 show a system for reduction of nitrogen oxides generated by a lean burn combustion engine, FIG. 2 show an injector, which according to the invention is adapted for injection of di-methyl ether into an exhaust conduit, and FIG. 3 show a flow chart of a method for reduction of nitrogen oxides from exhaust gases generated by a lean-burn internal combustion engine according to the invention.

DETAILED DESCRIPTION

Figure 1:
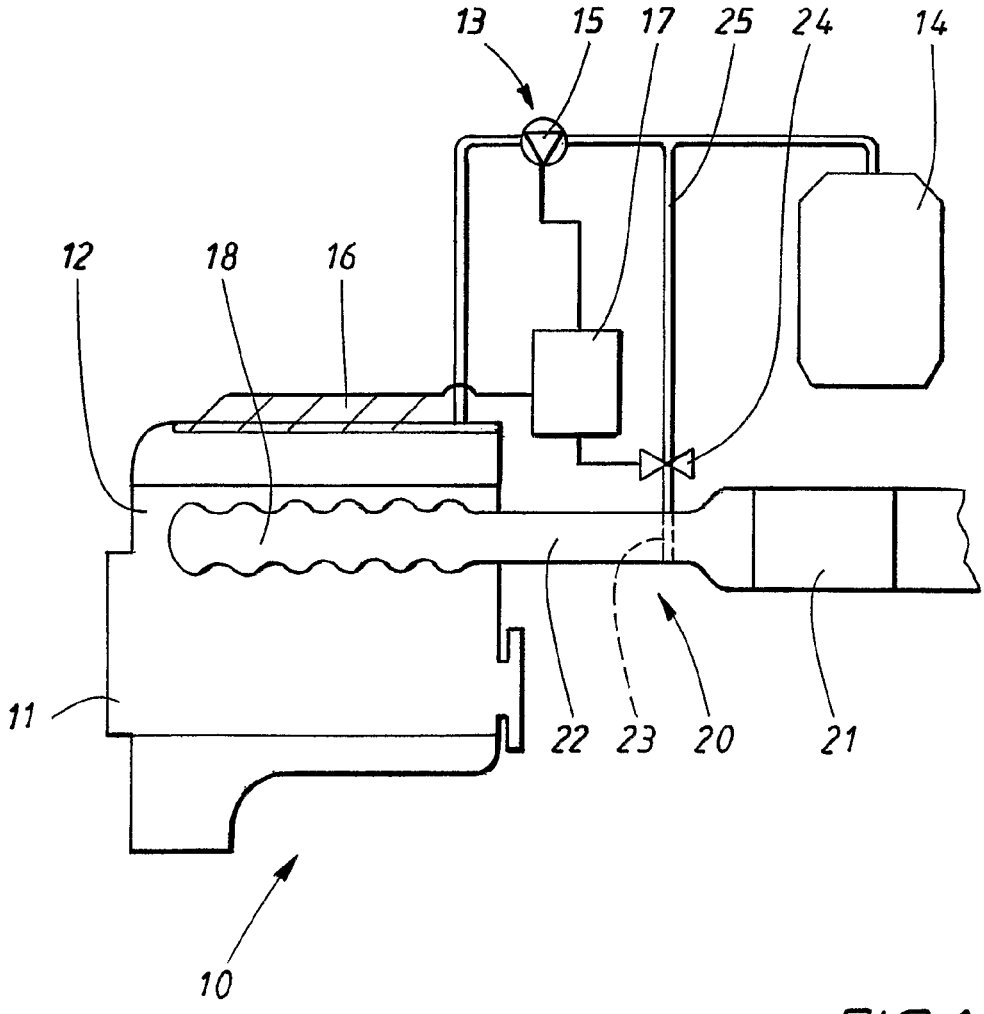

FIG. 1 shows a combustion engine 10 to which a system 20 for reduction of nitrogen oxides generated by the combustion engine is attached. The combustion engine is of lean burn type, that is the combustion is performed at an excess amount of air in relation to the amount of fuel present in the combustion. Typically for gasoline powered engines the air/fuel ratio would be over 18, for diesel powered engines the air fuel ratio would be from 22 to 40 and for di-methyl ether powered engines the air fuel ratio would be around 20-40. Preferably the engine is run on di-methyl ether. The engine is preferably of a multi cylinder type and includes an cylinder block 11, a cylinder head 12 in which a plurality of pistons are arranged in a plurality of cylinders are mounted for reciprocating movement, which linear movement is transferred into a rotational movement of a crank shaft arranged in the engine. A fuel injection system 13 is arranged to supply fuel into the engine. The fuel supply system is preferably arranged for supplying di-methyl ether to the cylinders of the engine. The fuel supply system includes a pressure tank 14, a high pressure pump 15 and injection means 16 which may be of common rail, port injection or direct injection type. The fuel injection is controlled by a control unit 17, which is conventionally arranged to control the engine.

The combustion engine 10 furthermore includes an exhaust manifold 18, to which said system 20 for reduction of nitrogen oxides are arranged. The system 20 for reduction of nitrogen oxides includes a lean NOx catalyst 21 arranged in an exhaust duct 22 connected to the exhaust manifold 18. The lean NOx catalysts may be of the type as described in EP 830201, U.S. Pat. No. 4,946,659; and US 2003/0069125. Preferably the catalytic material of the lean NOx catalyst is composed of a silver-alumina coating, cupper zeolite or silvermodenite.

An injector 23 is arranged in the exhaust duct 22 upstream of the lean NOx catalysts 21 for injecting a reduction agent for being used in the reduction of the nitrogen oxides contained in the exhausts. The injector is connected to a pressure tank 14 in which di-methyl-ether is stored under pressure in liquid state. In the event the engine is run on di-methyl ether, a common storage unit in the form of a pressure tank 14 may be used for the fuel needed in the combustions propelling the engine and for the di-methyl ether used as a reduction agent. Injection of the di-methyl ether through the injector 23 is controlled by a valve 24 opening and closing a passage between the pressure tank 14 and the injector 23. Since di-methyl ether is stored under pressure as a liquid, the injection may be propelled by the pressure difference between the pressure tank 14 and the pressure in the exhaust channel solely. Preferably the injector is arranged to inject the di-methyl ether in gaseous form into the exhaust conduit. The phase transition between liquid and gaseous phase, which occur at 6 bar at room temperature, should therefore occur before the di-methyl ether passes through the injection ports of the injector 23. Since the pressure tank 14 will contain di-methyl ether both in gaseous and liquid state, it is possible to make sure that only di-methyl ether in gaseous phase enters the duct 25 leading to the control valve 23.

Since di-methyl ether is injected in gaseous state, there will be no need for arranging mixers in between the injector 23 and the lean NOx catalyst 21. The distance between the injector 23 and the lean NOx catalyst 21 can also be reduced to be smaller than 30 cm, preferably smaller than 20 cm when installed in a system connected to an internal combustion engine having a cylinder volume between 10-15 liters.

Figure 2:
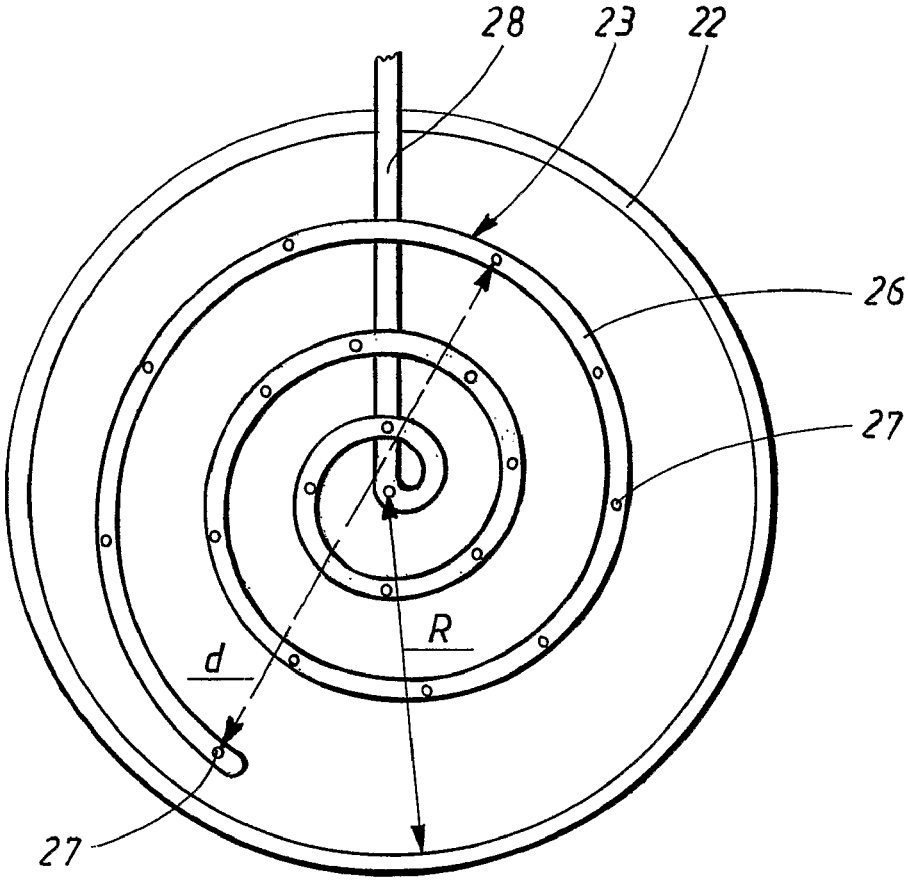

In FIG. 2 is shown an injector 23, which according to the invention is adapted for injection of di-methyl ether into an exhaust conduit 22. The injector 23 comprises a spiral portion 26 including a set of injection ports 27 distributed along the length of the spiral 26. The spiral portion 26 is connected to an inlet duct 28 which extents through the wall defining the exhaust duct 22.

The set of injection ports are preferably arranged in a matrix wherein the distance (d), in a radial direction of a cross section taken along an length axis of an exhaust conduit at a position where the injector is positioned, between the injection ports in said set of injection ports which are positioned most distant from each other, and an equivalent radius (R) of the lean NOx catalyst fulfill the following relationship: $d/R>0.5$. By distributing the injector ports in a matrix fulfilling the above relationship, an even distribution of the mass flow of di-methyl ether is accomplished without need of providing mixers in the exhaust duct. Preferably more than 6injector ports should be used. By equivalent radius is meant the radius of a circle having the same area of an cross section as the area the cross section of the actual catalyst, which may have a different shape.

Figure 3:
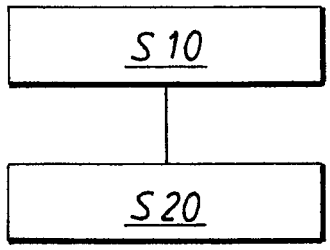

In FIG. 3 a flow chart of a method for reduction of nitrogen oxides from exhaust gases generated by a lean-burn internal combustion engine according to the invention is shown. In a first method step S10 exhaust gases generated by a lean-burn internal combustion engine are exposed to a lean NOx catalyst connected to an exhaust conduit of the lean-burn internal combustion engine. While exposing the lean NOx catalyst to exhausts di-methyl-ether is supplied as a reduction agent from a pressure tank to an injector and injecting di-methyl-ether upstream of said lean NOx catalyst in order to reduce the nitrogen oxides in a second method step S20.

The step of injection of the di-methyl ether the injection of di-methyl ether is preferably propelled by pressure generated by di-methyl-ether stored as a liquid in a pressure tank.

In a preferred embodiment a valve is arranged in a conduit connecting the injector with the pressure tank. The valve controls the injection of di-methyl ether, by opening and closing a fluid passage whereby, when the valve is in open state, the pressure in the pressure tank propels the injection of the di-methyl ether into the exhaust conduit.

Preferably the di-methyl ether is injected into the exhaust conduit in a gaseous state.

The invention claimed is:

1. System for reduction of nitrogen oxides from exhaust gases generated by a lean-bum internal combustion engine, comprising a lean NOx catalyst arranged to be connected to an exhaust conduit of the lean-burn internal combustion engine, an injector arranged for injecting a reduction agent to be used by the lean NOx catalyst in a reduction process, and a fuel tank containing the reduction agent, wherein the fuel tank is a pressure tank adapted to contain di-methyl-ether as a reduction agent and the injector is adapted to inject di-methyl-ether upstream of the lean NOx catalyst, wherein the injector includes a set of injection ports, wherein a distance (d), in a radial direction of a cross section taken along a length axis of an exhaust conduit at a position where the injector is positioned, between the injection ports positioned most distant from each other in the set of injection ports, and an equivalent radius (R) of the lean NOx catalyst fulfil the following relationship: $d/R>0.5$.

2. A system according to claim 1, wherein the set of injection ports is formed as a matrix of injector ports including at least 6 ports.

3. A system according to claim 1, wherein the injector is formed as a spirally shaped conduit having a plurality of openings provided along its length.

4. A system according to claim 1, wherein the pressure tank is adapted to store the di-methyl-ether as a liquid and injection is propelled by the pressure generated by the di-methyl-ether stored in the pressure tank.

5. A system according to claim 1, wherein a valve is arranged in a conduit connecting the injector with the pressure tank, and the valve is arranged to control the injection of di-methyl ether.

6. A system according to claim 1, wherein the injector is positioned directly upstream of the lean NOx catalyst without presence of a mixer in between said injector and the lean NOx catalyst.

7. A system according to claim 1, wherein the injector is arranged to inject di-methyl ether at a pressure lower than 6 bar absolute.

8. A system according to claim 1, wherein the catalytic material of the lean NOx catalyst comprises a silver-alumina coating.

9. A system according to claim 1, wherein the catalytic material of the lean NOx catalyst comprises cupper zeolite.

10. A system according to claim 1, wherein the catalytic material of the lean NOx catalyst comprises silvermodenite.

11. A system according to claim 1, wherein the system is arranged to support a phase transition of the di-methyl ether from liquid to gas before injection into the exhaust conduit.

12. A method for reduction of nitrogen oxides from exhaust gases generated by a lean-bum internal combustion engine, comprising the steps of exposing exhaust gases generated by a lean-bum internal combustion engine to a lean NOx catalyst connected to an exhaust conduit of the lean-burn internal combustion engine, supplying di-methyl-ether as a reduction agent from a pressure tank to an injector having a set of injection ports, wherein a distance (d), in a radial direction of a cross section taken along a length axis of an exhaust conduit at a position where the injector is positioned, between the injection ports positioned most distant from each other in said set of injection ports, and an equivalent radius (R) of the lean NOx catalyst fulfil the following relationship: $d/R>0.5$, and injecting di-methyl-ether upstream of the lean NOx catalyst in order to reduce the nitrogen oxides.

13. A method according to claim 12, wherein the injection of di-methyl ether is propelled by pressure generated by di-methyl-ether stored as a liquid in a pressure tank.

14. A method according to claim 13, wherein a valve is arranged in a conduit connecting the injector with the pressure tank, and the valve controls the injection of di-methyl ether, by opening and closing a fluid passage whereby, when the valve is in open state, pressure in the pressure tank propels injection of the di-methyl ether into the exhaust conduit.

15. A method according to claim 12, wherein the injector injects di-methyl ether at a pressure lower than 6 bar absolute.

16. A method according to claim 12, wherein the system supports a phase transition of the di-methyl ether from liquid to gas before injection into the exhaust conduit.

* * * * *